United States Patent [19]

Manning et al.

[11] Patent Number: 4,566,590

[45] Date of Patent: Jan. 28, 1986

[54] RECORDED AND PRINTED MESSAGE CARRIER

[76] Inventors: Larry F. Manning, 4706 Kester, Sherman Oaks, Calif. 91403; Andrea Stanley, 409 Winchester Ave., Glendale, Calif. 91201

[21] Appl. No.: 648,000

[22] Filed: Sep. 6, 1984

[51] Int. Cl.[4] ..... B65D 85/57; B65D 85/62; B65D 85/672

[52] U.S. Cl. ..... 206/232; 206/216; 206/312; 206/387; 229/72

[58] Field of Search ..... 206/216, 232, 307, 309–313, 206/387, 579; 229/72

[56] References Cited

U.S. PATENT DOCUMENTS

| | | | |
|---|---|---|---|
| 1,479,794 | 1/1924 | Emerson | 206/309 |
| 2,097,916 | 11/1937 | Elmore | 229/72 |
| 3,009,707 | 11/1961 | Schulein | 206/312 |
| 3,107,783 | 10/1963 | Corey et al. | 206/310 |
| 3,207,318 | 9/1965 | Gilbert | 206/309 |
| 3,516,598 | 6/1970 | Martins | 206/309 |
| 4,255,872 | 3/1981 | Williams | 206/232 |
| 4,327,831 | 5/1982 | Inaba et al. | 206/313 |

FOREIGN PATENT DOCUMENTS

| | | | |
|---|---|---|---|
| 1312778 | 4/1973 | United Kingdom | 206/313 |

*Primary Examiner*—George E. Lowrance
*Assistant Examiner*—Jimmy G. Foster
*Attorney, Agent, or Firm*—Roger A. Marrs

[57] ABSTRACT

A carrier or storage enclosure for holding recorded message and printed message mediums is disclosed herein having an elongated backing sheet of material and a pair of front sheets secured to the backing sheet along the common exterior peripheral edges thereof leaving the opposing interior edges of the front sheets open and available for insertably receiving the message carrying mediums. A storage pouch is carried on a selected one of the front sheets for holding a messge on a magnetic tape medium. At least the front sheets are composed of transparent material exposing printed display labels or messages carried on the inserted mediums so that the labels or messages are available to the viewer for reading without the necessity of message medium removal. The backing sheet and pair of front sheets constitute a pair of pockets for removably housing the respective recorded and printed message mediums and scorelines define a hinge section provided in the backing sheet separating the pair of pockets which serves as a hinge and binding so that the pockets and pouch may be folded over upon themselves.

1 Claim, 3 Drawing Figures

FIG. 1
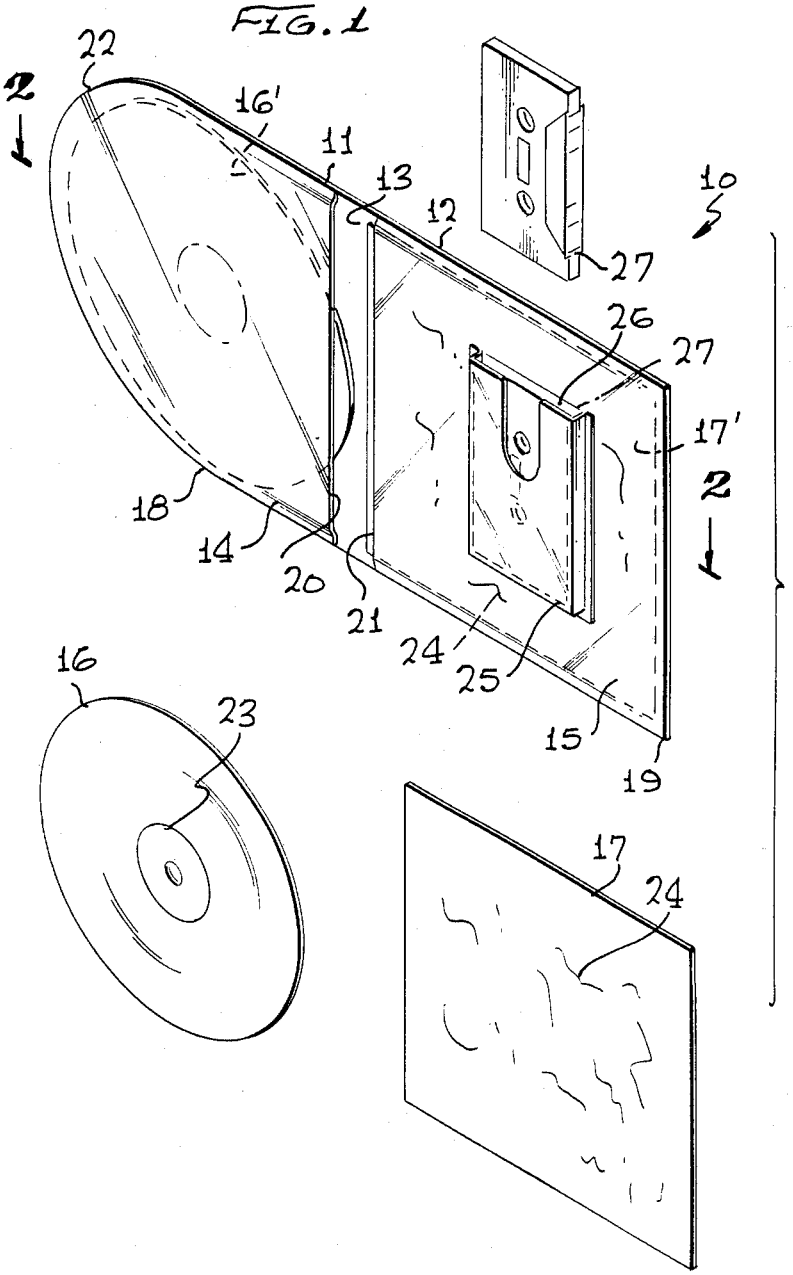
FIG. 2
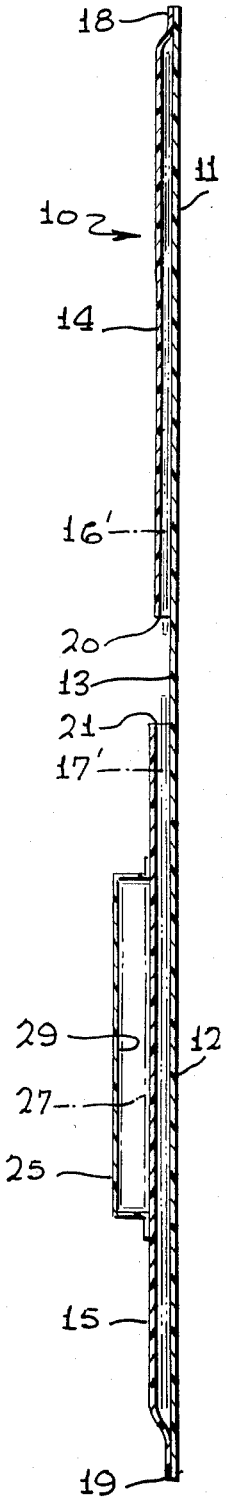
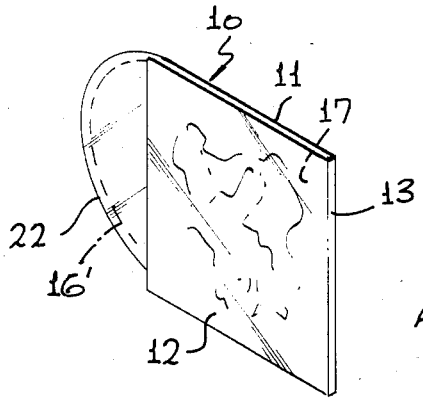
FIG. 3

RECORDED AND PRINTED MESSAGE CARRIER

BACKGROUND OF THE INVENTION

1. Field of the Invention

The present invention relates to storage devices and, more particularly, to a novel storage carrier for holding printed and recorded messages in a pair of adjacent pockets and an overlapping pouch so that the labels and/or printed message may be read without removal of the recording or printed medium.

2. Brief Description of the Prior Art

In the past, it has been the conventional practice to record messages on magnetic tape, disks or circular records and to additionally print messages or other pictorial subject matter on cards commonly known as greeting cards. Usually, the record mediums are sold separately and used independently of one another and the messages played on the disk record, magnetic tape or the printed medium are not correlated or corresponding to each other in any manner, way, shape or form.

Although such prior attempts at providing suitable and novel communications by the use of sound recordings and printed messages have been successful, difficulties and problems have arisen which stem largely from the fact that it is sometimes desirable to coordinate the pictorial, written and vocal messages in order to more effectively communicate with the recipient of the messages. It may be that the sender desires to play background music on the recorded medium while the printed message will carry a personal message accompanied by the music. In other instances, the record may carry vocal greetings, political speeches and messages from a variety of individuals while the printed message may carry a poem or other long lasting sentimental message. The communication impact is greatly enhanced by combining and correlating the vocal or musical recording along with the printed message and graphic or pictorial subject matter.

In the event that both the recorded medium and the printed medium are intended to be combined for communication purposes, a long standing need has been present to provide a suitable carrier or holder for storing or housing the message mediums whether they are recorded or printed and for displaying some of the label or printed message material so that the mediums need not be removed for identification purposes.

SUMMARY OF THE INVENTION

Accordingly, the above problems and difficulties have been obviated by the present invention which provides a novel carrier or holder for a recorded medium and a printed message medium which is comprised of an elongated sheet of flexible material having score-lines provided between its opposite ends constituting a hinge section so that the backing sheet may be folded over upon itself. A pair of front sheets are secured along common exterior peripheral edges of both the backing sheet and the front sheets so that a pair of pockets are defined and are separated by the hinge section provided on the backing sheet. A pouch is carried on one front sheet adapted to house a tape cassette. Slits or openings are employed on each of the respective pockets and pouch to accommodate insertion and removal of message mediums. Preferably, the front sheets are composed of a transparent or translucent material and the pocket carrying the recorded message medium is rounded about its extreme end so as to conform to the configuration of a circular record medium such as a disk.

Therefore, it is among the primary objects of the present invention to provide a novel storage holder or housing for carrying at least a pair of recorded and printed record mediums wherein the mediums may be carried and combined as a unit.

Another object of the present invention is to provide a novel carrier or holder for a circular record medium, a printed message medium and a tape cassette wherein the label and printed message are visible through the carrier or holder to the observer without the necessity of medium removal.

Yet another object of the present invention is to provide a novel carrier or holder for removably storing a pair of record mediums containing audible information and a printed record medium for containing visibly observable information wherein the information contained on these mediums is corresponding and correlated so that the commonalty of storage in a single contained is advantageous.

Still a further object of the present invention is to provide a novel holder for a recorded and a printed message medium which is inexpensive and which is convenient for the recipient of the message to withdraw the mediums for playback or review.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front perspective view of the novel recorded and printed message carrier of the present invention;

FIG. 2 is a longitudinal cross-sectional view of the carrier shown in FIG. 1 as taken in the direction of arrows 2—2 thereof; and FIG. 3 is a perspective view of the carrier in its folded condition with the recorded and printed message mediums inside.

DESCRIPTION OF THE PREFERRED EMBODIMENT

Referring to FIG. 1, the novel recorded and printed message carrier of the present invention is illustrated in the general direction of arrow 10 which includes a continuous backing sheet having a pair of backing sheets 11 and 12 separated by a central hinge portion 13 extending between an upper edge and a lower edge of the continuous backing sheet. A pair of front sheets 14 and 15 are secured to the backing sheet on opposite sides of the hinge portion 13 so as to provide a pair of pockets for insertably receiving a recorded message medium such as a circular record 16 and a printed message medium such as a card or paper sheet 17.

The front sheets 14 and 15 are preferably secured to each backing sheet so that the corresponding exterior peripheral edges of the backing and front sheets are held together by suitable means. For example, if the backing sheet and front sheets are composed of a plastic or plastic-like material, heat sealing seams are provided along the corresponding peripheral edge marginal regions to effect securement. With respect to the pocket defined by front sheet 14, the edge marginal securement region is indicated by numeral 18 and numeral 19 represents a similar sealing or securement region associated with the front sheet 15. When the front sheets 14 and 15 are secured as described above, their opposing edges represented by numerals 20 and 21 are open and define entrances leading into the interior of the respective pockets so that the circular record 16 may be inserted between the front sheet 14 and the backing sheet 11 while the card or paper sheet 17 may be inserted through the entrance and secured between the front sheet 15 and the backing sheet 12.

Inasmuch as the circular record or disk 16 represents a rounded contour, it is necessary that the backing sheet 11 and face sheet 14 be rounded so as to more fittingly correspond to the shape of the record 16. Therefore, a selected one of the storage pockets is rounded at its end opposite from its entrance so as to accommodate the circular configuration of the record. A typical selected end illustrating such a configuration is broadly identified by numeral 22.

It can be seen that the circular record 16 is provided with a label 23 which generally includes printed indicia, information, symbols or graphic subject matter which is visible through at least sheet 14 when sheet 14 is composed of transparent or translucent material. In a similar fashion, the printed sheet or card 17 includes printed subject matter, graphic or other indicia as represented in general by numeral 24 which would be visible through the translucent or transparent front sheet 15 when the sheet or card is inserted in the respective pocket. The circular record 16 is identified by numeral 16' as being inserted within the pocket associated with front sheet 14 while the printed message sheet of card 17 is identified by numeral 17' inserted inside the pocket associated with front sheet 15.

A storage pouch 25 is provided by sealing the edges of a sheet to the exterior surface of face sheet 15 leaving the side open to define an entrance 26. The pouch insertably receives a magnetic tape cassette 27 for storage. The entrances 21 and 26 are at a right angle or normal with respect to each other. Pouch 25 includes a central recess 29 between two raised portions so as to conform with the shape of a standard cassette and to snugly fit therewith to retain the cassette in place.

Referring now in detail to FIG. 2, it can be seen that the edged marginal region of the backing sheets 11 and 12 and front sheets 14 and 15 are heat-sealed together to form securement as represented by numerals 18 and 19. Also, the opposing edges 20 and 21 of the respective front sheets 14 and 15 define the entrances leading into the interior of the respective pocket associated with each of the front sheets. When it is desired to store or transport the carrier including the recorded and printed message information therein, the backing sheets 11 and 12 may be folded over upon itself by pivoting along the scorelines or hinged portion 13 so that the respective front sheets 14 and 15 will lie against each other as shown in FIG. 3.

The hinge portion 13 is wide enough to accommodate the thickness of the cassette 27 as shown in broken lines. By placing the pouch 25 centrally on sheet 15, no interference results in folding the sheets along the hinge.

FIG. 3 shows the folded configuration of the present invention while FIGS. 1 and 2 illustrate the carrier as being unfolded so that the record or card may be inserted or withdrawn from the respective pockets. When the carrier is folded, the rounded portion 22 of the pocket associated with front sheet 14 extends beyond the peripheral edge or end of the square pocket defined by front sheet 15.

Therefore, in view of the foregoing, it can be seen that the novel carrier in the present invention provides a suitable means for shipping, transporting or storing recorded and printed message mediums. Information contained on the mediums is available for review through the transparent or translucent material and the construction is such that the front sheets may be readily attached to the backing sheet in an inexpensive and secure manner.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A recorded and printed message carrier comprising:

a record medium having audio recorded data carried thereon;

a printed message medium having visible indicia carried thereon;

an elongated backing sheet of pliable, transparent material having a hinge portion mid-way between the opposite ends constituting a hinge for folding said backing sheet over upon itself;

a first and a second front sheet of material attached to the edge marginal regions adjacent to the peripheral edge of said backing sheet;

said front sheets having exterior outer edges corresponding to and following said backing sheet at its opposite ends and separated from each other by said hinge portion so as to constitute a pair of open pockets for insertably receiving said record medium and said printed message medium respectively;

said record medium disposed in one of said pair of open pockets and said printed message medium disposed in said other open pocket of said pair;

said first and second sheets include unattached opposing edges in spaced apart parallel relationship separated by said hinge portion which constitutes entrances leading into each of said respective pockets;

said first and second sheets are composed of transparent material for visually exposing said record and printed message mediums therethrough;

said record medium is a circular disk having pictorial indicia carried thereon and said printed message medium is square cornered;

each of said backing sheet ends and corresponding front sheets defining said pockets is configured to conform to the external circular shape of said record medium and said square cornered printed message medium respectively;

said backing sheet carrying said pocket insertably receiving said circular record medium is substantially longer in length than said pocket insertably receiving said square cornered record medium;

a third front sheet of material attached along its edge marginal regions to a selected one of said first and second front sheets and having an opening normal to said first and second sheets opposing edges and to said hinge portion for insertably receiving a recorded medium taking the form of a magnetic tape cassette;

said tape cassette having a thickness substantially greater than the thickness of said disk record medium and said printed message medium;

said third sheet constituting a third pocket having its opening in alignment normal to said opening of said pocket sheet on which it is carried;

said backing sheet is composed of a transparent material visually exposing the sides of said record and printed message mediums opposite to their sides visually exposed through said front sheets;

said hinge portion is of a width at least equal to the thickness of said first mentioned pocket and said third pocket so as to accommodate said medium thicknesses when folded over upon themselves; and a plurality of scorelines carried laterally across said hinge portion defining pivotal axis for rotating said backing sheet.

* * * * *